United States Patent [19]

James

[11] 4,188,987

[45] Feb. 19, 1980

[54] LOG SPLITTING ATTACHMENT

[76] Inventor: Robert G. James, 3509 Janene Way, Bakersfield, Calif. 93306

[21] Appl. No.: 944,752

[22] Filed: Sep. 22, 1978

[51] Int. Cl.[2] ..... B27L 7/00

[52] U.S. Cl. ..... 144/193 R; 144/194; 145/116 R

[58] Field of Search ..... 144/3 K, 193 R, 193 A, 144/193 C, 193 D, 194, 323; 30/122; 145/114.5, 116.R, 122, 124

[56] References Cited

U.S. PATENT DOCUMENTS

| | | | |
|---|---|---|---|
| 1,319,656 | 10/1919 | Mervin | 144/193 R |
| 2,659,255 | 11/1953 | Bates | 145/116 R |
| 3,180,379 | 4/1965 | Stewart | 145/116 R |
| 3,670,789 | 6/1972 | Long | 144/193 D |
| 3,982,572 | 9/1976 | Kortendick | 144/193 B |
| 3,993,113 | 11/1976 | Thackery | 144/193 D |
| 4,026,337 | 5/1977 | Thackery | 144/193 R |
| 4,027,709 | 6/1977 | Thackery | 144/193 R |
| 4,076,062 | 2/1978 | Kanik | 144/193 A |
| 4,091,851 | 5/1978 | Ober | 144/3 K |
| 4,121,636 | 10/1978 | James | 144/193 R |

FOREIGN PATENT DOCUMENTS

| | | | |
|---|---|---|---|
| 2622072 | 12/1976 | Fed. Rep. of Germany | 144/193.R |
| 1120159 | 7/1956 | France | 144/194 |

*Primary Examiner*—Robert L. Spruill
*Assistant Examiner*—W. D. Bray
*Attorney, Agent, or Firm*—I. Michael Bak-Boychuk

[57] ABSTRACT

Disclosed herein is an attachment adapted to be engaged to the power head of a chain saw, said attachment including chain reduction to drive a shaft terminating in a tapered screw. The shaft itself is provided with spline cuts along the longitudinal exterior thereof on which yet another tapered frustum is engaged. The frustum is biased away from the end screw by a return spring, the tapered screw being cut with a low pitch thread on the exterior thereof while the frustom being provided with a substantially higher pitched exterior threading. Formed adjacent the shaft is a torque reaction wedge extending proximate the tapered screw, the wedge being insertable into the split formed by the screw to oppose any torsion generated thereby.

6 Claims, 5 Drawing Figures

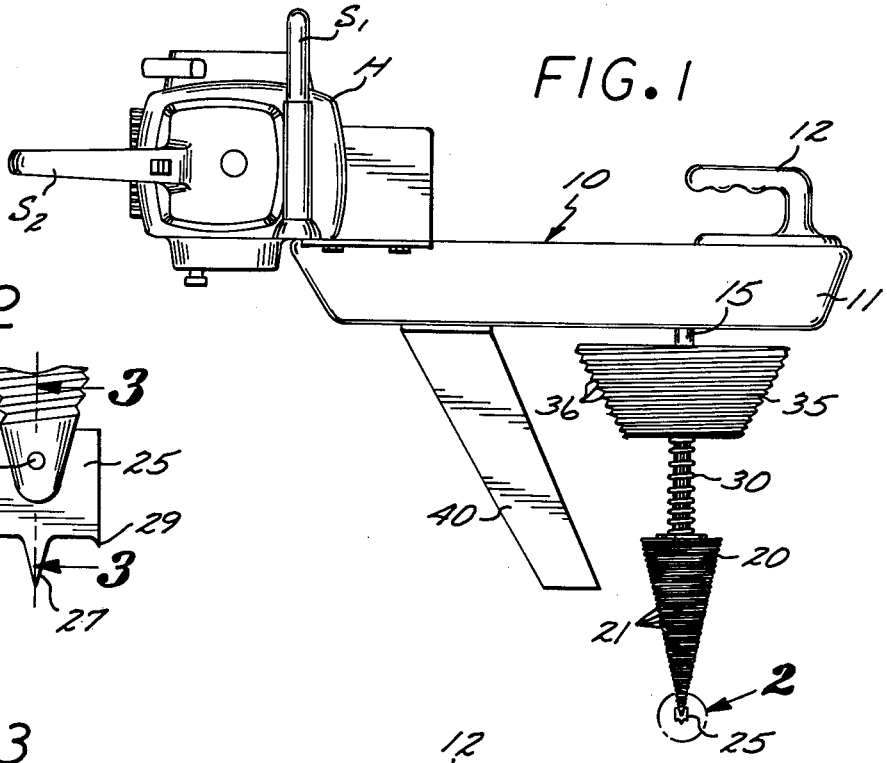
FIG. 1
FIG. 2
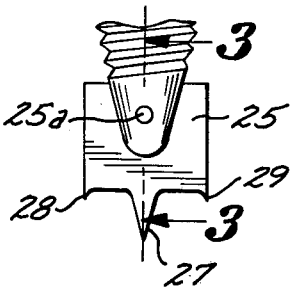
FIG. 3
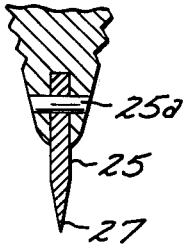
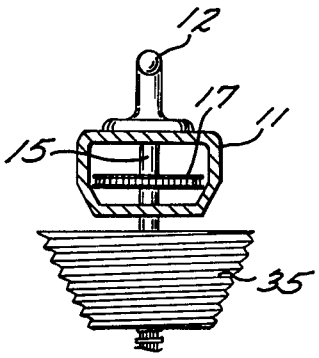
FIG. 5
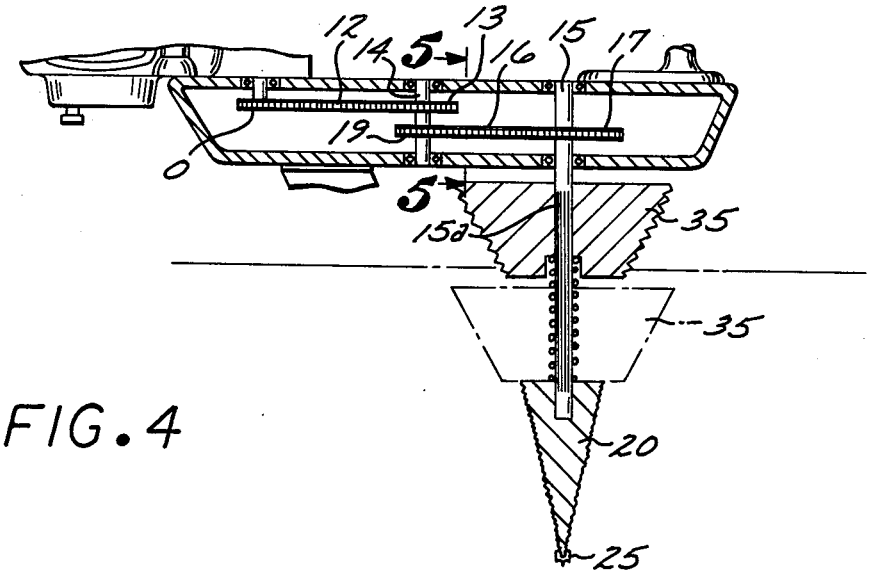
FIG. 4

LOG SPLITTING ATTACHMENT

BACKGROUND OF THE INVENTION

1. Field of the Invention

The present invention relates to log splitters, and more paticularly to log splitting attachments adapted to engage the power head of a chain saw.

2. Description of the Prior Art

Log splitting devices have been known in the past. In my prior U.S. patent application Ser. No. 817,561 filed July 21, 1977, now U.S. Pat. No. 4,121,636, I have set out an attachment wherein a wedge is advanced along a threaded shaft to split any wood placed therebetween. Since that time I have found an alternative implementation utilizing tapered screws for splitting the log sideways. Heretofore, most tapered screw log splitters do not provide any means for parting the split. Furthermore, taper screw log splitters were most frequently utilized with power take-offs from an automobile or other large power source where the torque reaction was achieved through contact with ground.

SUMMARY OF THE INVENTION

Accordingly it is the general purpose and object of the present invention to provide a tapered screw log splitter having means for separating the split.

Other objects of the invention are to provide a tapered screw log splitter adapted to be driven by the power head of a conventional chain saw.

Yet additional objects of the present invention are to provide a tapered screw log splitter which by way of two different thread patterns assures separation of the split.

Briefly these and other objects are accomplished within the present invention by providing a log splitting attachment adapted to be powered by the power head of a chain saw, the attachment comprising a housing which includes chain reduction connected between the chain saw sprocket and an output shaft. The shaft itself is splined over a section of the exposed surface thereof, terminating at the free end in a tapered screw which at its apex is provided with a drill tip for forming the starting hole. Deployed on the splined section of the shaft is yet another tapered cone frustum provided with exterior threads of a higher pitch than the threads formed on the tapered screw. This frustum is separated from the tapered end screw by way of a spring and it is against this spring that the frustum is brought down by virtue of the thread differential.

Included further is an anti torque wedge aligned adjacent the shaft which by virtue of this alignment will oppose the split surfaces of the log thus taking out the torque produced in the course of splitting.

BRIEF DESCRIPTION OF THE DRAWING

FIG. 1 is a side view of a log splitting attachment constructed according to the present invention;

FIG. 2 is a detail view of an end tip implementation useful with the invention herein;

FIG. 3 is a sectional detail view taken along line 3—3 of FIG. 2;

FIG. 4 is a side view in section illustrating the internal features of the log splitting attachment set out herein; and FIG. 5 is a sectional end view taken along line 5—5 of FIG. 4.

DESCRIPTION OF THE SPECIFIC EMBODIMENTS

As shown in FIG. 1 the inventive log splitting attachment generally designated by the numeral 10 comprises a housing 11 of elongate shape secured at one end to the securing fixtures normally found on the power head of a chain saw shown herein as power head H. In order to facilitate manipulation of the structure as it is now combined, housing 11 is provided with a handle 12 proximate the free end thereof and the power head H includes the conventionally found grasping surfaces shown herein as surfaces S1 and S2. Extending from the housing 11 in the direction opposite to the handle 12 is a shaft 15 terminating in a tapered screw 20 which at the free end forms an apex provided with a boring or drill tip 25.

Deployed around shaft 15 and extending above the base or the wide surface of screw 20 is a spring 30 which opposes at the other end a tapered frustum 35 secured in splined engagement to the exterior of shaft 15. In this manner frustum 35 is free to translate against spring 30 down towards the base of the tapered screw 20, this translation being achieved by way of two different thread patterns, screw 20 being provided with a low pitch thread pattern shown by way of threads 21 while frustum including a higher exterior thread pattern 36.

By virtue of this arrangement it is contemplated to press the drill tip 25 into the lateral exterior of a log, the drill tip forming the necessary bore which when sufficiently deep will engage the thread 21 on the exterior of screw 20. Once the threads engage the log the combined action of the boring tip and the thread pitch will advance the tapered screw 20 into the log. As this advancing engagement continues a split will eventually form in the log surface into which a planar cantelevered anti torque bar or wedge 40 may be inserted.

More specifically, wedge 40 extends from housing 11 along a plane including the shaft 15, the free end of wedge 40 terminating adjacent the larger section of the tapered screw 20. Once wedge 40 is thus inserted into any splits formed, the torque produced by the advancement of the screw is then opposed against the split. As the tapered screw 20 is fully advanced into the interior of the log the edges of the split engage the threads 36 on the exterior of frustum 35. Threads 36, being of a higher pitch than the advancing threads 21, result in a faster advancement of the frustum 35 than that achieved by the screw 20. In this manner the larger circumference of the frustum will further force any splits formed to separate, providing the necessary wedging or forcing function to split the log.

Once the log is split the opposing bias of spring 30 will then return the wedge or the frustum 35 upwardly towards the housing 11 to begin the splitting of the next log.

With the foregoing general description reference should be had to FIGS. 2 and 3 for the specific implementation of the drill tip 25. More specifically as shown in FIGS. 2 and 3, the end apex of screw 20 is provided with a transverse, axially aligned, cut or groove 26 conformed to receive a flat boring tip referred to above as the tip 25.

Tip 25 is provided with the center auger point 27 and the necessary edge points 28 and 29 to bore out the necessary opening for the eventual engagement of threads 21. It is contemplated to secure the tip 25 in the groove 26 by way of any conventional fastening means, the means illustrated herein being by way of a pin 25*a* extending laterally across the common structure of the screw 20 and tip 25.

The foregoing arrangement of parts is driven in rotation by way of a gearing arrangement shown in detail in FIGS. 4 and 5. More specifically, as shown in FIG. 4, housing 11 comprising a hollow structure receiving at one end thereof the conventionally found output sprocket 0. Sprocket 0, by way of a first chain 42, drives yet another sprocket 13 engaged to an idler shaft 14 which also carries in similar engagement a gear reducing sprocket 19. Sprocket 19 in turn is engaged by a chain 16 to a drive sprocket 17 secured to shaft 15. Shaft 15, as set out hereinabove, includes a spline section 15*a* on which the above-mentioned frustum 35 is engaged. Thus frustum 35 is free to slide against the bias of spring 30 along the spline section 15*a* to a position shown as $35_1$. In this position the abutting relationship of frustum 35 against screw 20 and the larger diameter of frustum 35 combine to result in the major advancing force being generated by threads 36. At this poitn the split in the log is practically complete and any further advancement into the log interior will result in full separation thereof.

To achieve the necessary clearances into the interior of the log, housing 11 is made of a smaller section than the largest diameter of frustum 35. More specifically as shown in FIG. 5 the central axis of shaft 15 extends through housing 11 in plane with the handle 12, the largest lateral projection being thus formed by the upper surface of the frustum.

By proper inclination of the assembly in the initial engagement thereof with the log it is thus possible to pass the housing into the interior of the split until the log is fully separated.

Obviously many modifications and changes may be made to the foregoing description without departing from the spirit of the invention. It is therefore intended that the scope of the invention be determined solely on the claims appended hereto.

What is claimed is:

1. A log splitting attachment adapted to be secured to the power head of a chain saw said power head including an output sprocket comprising:

an elongate hollow housing attachable to said power head and receiving said output sprocket at one end thereof;

reduction means deployed in said housing and connected to said output sprocket for producing a reduced angular output rate;

an output shaft mounted for rotation in said housing and engaged to said reduction means, said output shaft extending transversely to the exterior of said housing and including splines formed on the exterior surfaces thereof;

a tapered screw attached at the base thereof to the free end of said output shaft, said screw including a first thread formed on the exterior thereof;

a tapered frustum slidably mounted on said splines of said output shaft and including a second thread formed on the exterior thereof, said second thread having a pitch of greater advance than said first thread; and spring means deployed between said screw and said frustum for urging said frustum away from said screw.

2. Apparatus according to claim 1 further comprising:

a diametric slot formed in the apex of said tapered screw; and a boring bit securable in said slot.

3. Apparatus according to claim 1 further comprising:

an elongate torque reacting bar attached in cantelever from said housing and extending along said shaft and said screw.

4. Apparatus for splitting wood comprising:

a source of rotary power having a rotary output drive;

a housing attached to said source and adapted to receive said output drive on the interior thereof;

an output shaft mounted for rotation in said housing and operatively engaged to said output drive, said output shaft extending transversely to the exterior of said housing and including splines formed on the exterior surfaces thereof;

a tapered screw attached at the base thereof to the free end of said output shaft, said screw including a first thread formed on the exterior thereof;

a tapered frustum slidably mounted on said splines of said output sahft and including a second thread formed on the exterior thereof, said second thread having a pitch of greater advance than said first thread; and spring means deployed between said screw and said frustum for urging said frustum away from said screw.

5. Apparatus according to claim 4 further comprising:

a diametric slot formed in the apex of said tapered screw; and a boring bit securable in said slot.

6. Apparatus according to claim 4 further comprising:

an elongate torque reacting bar attached in cantelever from said housing and extending along said shaft and said screw.

* * * * *